US009598924B2

(12) United States Patent
Nguyen et al.

(10) Patent No.: US 9,598,924 B2
(45) Date of Patent: Mar. 21, 2017

(54) WELLHEAD HANGER WITH SPACER TO REDUCE BREAK-OUT TORQUE

(71) Applicant: Cameron International Corporation, Houston, TX (US)

(72) Inventors: Dennis P. Nguyen, Pearland, TX (US); Jay P. Painter, Friendswood, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/209,469

(22) Filed: Mar. 13, 2014

(65) Prior Publication Data

US 2015/0260002 A1 Sep. 17, 2015

(51) Int. Cl.
*E21B 33/04* (2006.01)
*E21B 43/10* (2006.01)

(52) U.S. Cl.
CPC ..... *E21B 33/0415* (2013.01); *E21B 43/10* (2013.01)

(58) Field of Classification Search
None
See application file for complete search history.

(56) References Cited

U.S. PATENT DOCUMENTS

| | | | | |
|---|---|---|---|---|
| 2,103,601 | A | 12/1937 | Stigall | |
| 3,625,283 | A | 12/1971 | Ahlstone | |
| 4,051,896 | A * | 10/1977 | Amancharla et al. | 166/123 |
| 4,171,018 | A | 10/1979 | Walker | |
| 4,416,472 | A * | 11/1983 | Fowler | E21B 33/043 166/217 |
| 8,528,650 | B1 | 9/2013 | Smith et al. | |
| 8,662,189 | B2 * | 3/2014 | Harsono et al. | 166/382 |
| 2008/0230229 | A1 | 9/2008 | Shaw et al. | |

OTHER PUBLICATIONS

Hanson et al. (inventors), U.S. Appl. No. 13/867,947, filed Apr. 22, 2013.
Massey et al. (inventors), U.S. Appl. No. 14/194,299, filed Feb. 28, 2014.

* cited by examiner

*Primary Examiner* — Jennifer H Gay
*Assistant Examiner* — Caroline Butcher
(74) *Attorney, Agent, or Firm* — Eubanks PLLC

(57) ABSTRACT

A wellhead hanger assembly is provided. In one embodiment, a system includes a wellhead hanger, such as a casing hanger. This system also includes a spacer ring positioned along a neck of the wellhead hanger between a threaded portion of the neck and a shoulder of the wellhead hanger. In at least some instances, the spacer ring may cooperate with a running tool threaded onto the wellhead hanger to reduce the break-out torque needed for disconnecting the running tool from the wellhead hanger. Additional systems, devices, and methods are also disclosed.

6 Claims, 4 Drawing Sheets

WELLHEAD HANGER WITH SPACER TO REDUCE BREAK-OUT TORQUE

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various casings, valves, hangers, pumps, fluid conduits, and the like, that facilitate drilling or production operations.

As will be appreciated, various tubular strings can be run into wells through wellhead assemblies. For instance, wells are often lined with casing that generally serves to stabilize the well and to isolate fluids within the wellbore from certain formations penetrated by the well (e.g., to prevent contamination of freshwater reservoirs). Such casing is frequently cemented into place within the well. During a cement job, cement can be pumped down a casing string in a well, out the bottom of the casing string, and then up the annular space surrounding the casing string. The cement is then allowed to set in the annular space. Wells can also include tubing strings that facilitate flow of fluids through the wells. Hangers can be attached to the casing and tubing strings and received within wellheads to enable these tubular strings to be suspended in the wells from the hangers.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to hangers for suspending tubular strings from wellheads. In some instances, these wellhead hangers can be attached to the tubular strings and installed in a wellhead assembly with running tools threaded onto the hangers. Once a wellhead hanger is installed in the wellhead, the running tool can be unthreaded from the hanger. In certain embodiments, a wellhead hanger includes a spacer that facilitates disconnection of the running tool from the hanger. In one embodiment, the wellhead hanger includes left-handed and right-handed threaded portions for engaging mating threads of the spacer and the running tool. The spacer, the running tool, and the wellhead hanger cooperate with one another to inhibit over-torquing of the running tool onto the hanger and to reduce the break-out torque needed to begin unthreading the running tool from the hanger.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
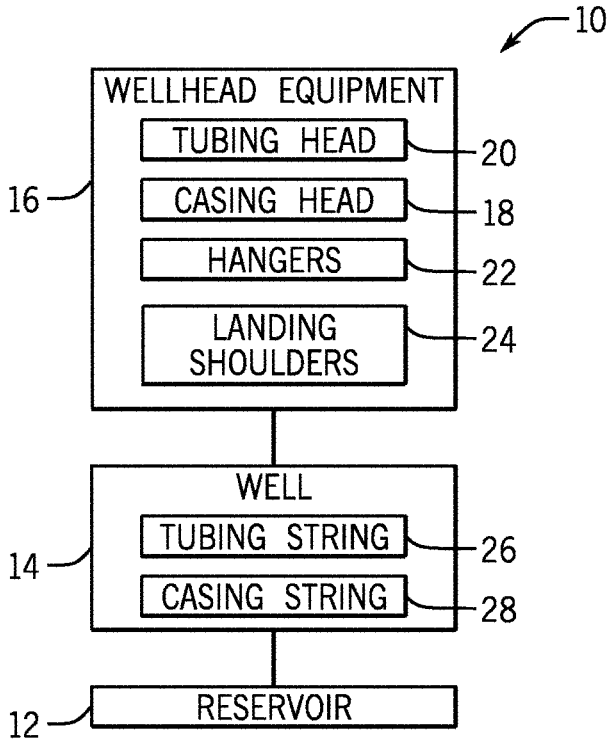
FIG. 1 generally depicts various components, including one or more tubular strings and associated hangers, that can be installed at a well in accordance with one embodiment of the present disclosure.

Turning now to the present figures, a system 10 is illustrated in FIG. 1 in accordance with one embodiment.

Notably, the system 10 is a production system that facilitates extraction of a resource, such as oil, from a reservoir 12 through a well 14. Wellhead equipment 16 is installed on the well 14. As depicted, the wellhead equipment 16 includes at least one casing head 18 and tubing head 20, as well as wellhead hangers 22. But the components of the wellhead equipment 16 can differ between applications, and could include a variety of casing heads, tubing heads, spools, hangers, sealing assemblies, stuffing boxes, pumping tees, and pressure gauges, to name only a few possibilities.

The wellhead hangers 22 can be positioned on landing shoulders 24 within hollow wellhead bodies (e.g., within the tubing and casing heads). These landing shoulders 24 can be integral parts of tubing and casing heads or can be provided by other components, such as sealing assemblies or landing rings disposed in the tubing and casing heads. Each of the hangers 22 can be connected to a tubular string, such as a tubing string 26 or a casing string 28, to suspend the string within the well 14. The well 14 can include a single casing string 28 or include multiple casing strings 28 of different diameters. Casing strings 28 are often cemented in place within the well. During a cement job, cement is typically pumped down the casing string. A plug is then pumped down the casing string with a displacement fluid (e.g., drilling mud) to cause the cement to flow out of the bottom of the casing string and up the annular space around the casing string.

Rotating a casing string during cementing can increase uniformity of the cement about the casing string and reduce the size or frequency of undesirable cavities or fissures in the cement. Further, rotating tubular strings can also facilitate running of the strings into the well through the wellhead. Any suitable devices or machines may be used to rotate the wellhead hangers (and their attached tubular strings) and to run the strings into wells. For example, a top drive can be used to run a casing string into a well and to rotate the casing string. In some instances, the tubular strings are rotated via wellhead hangers attached to the strings.

Figure 2:
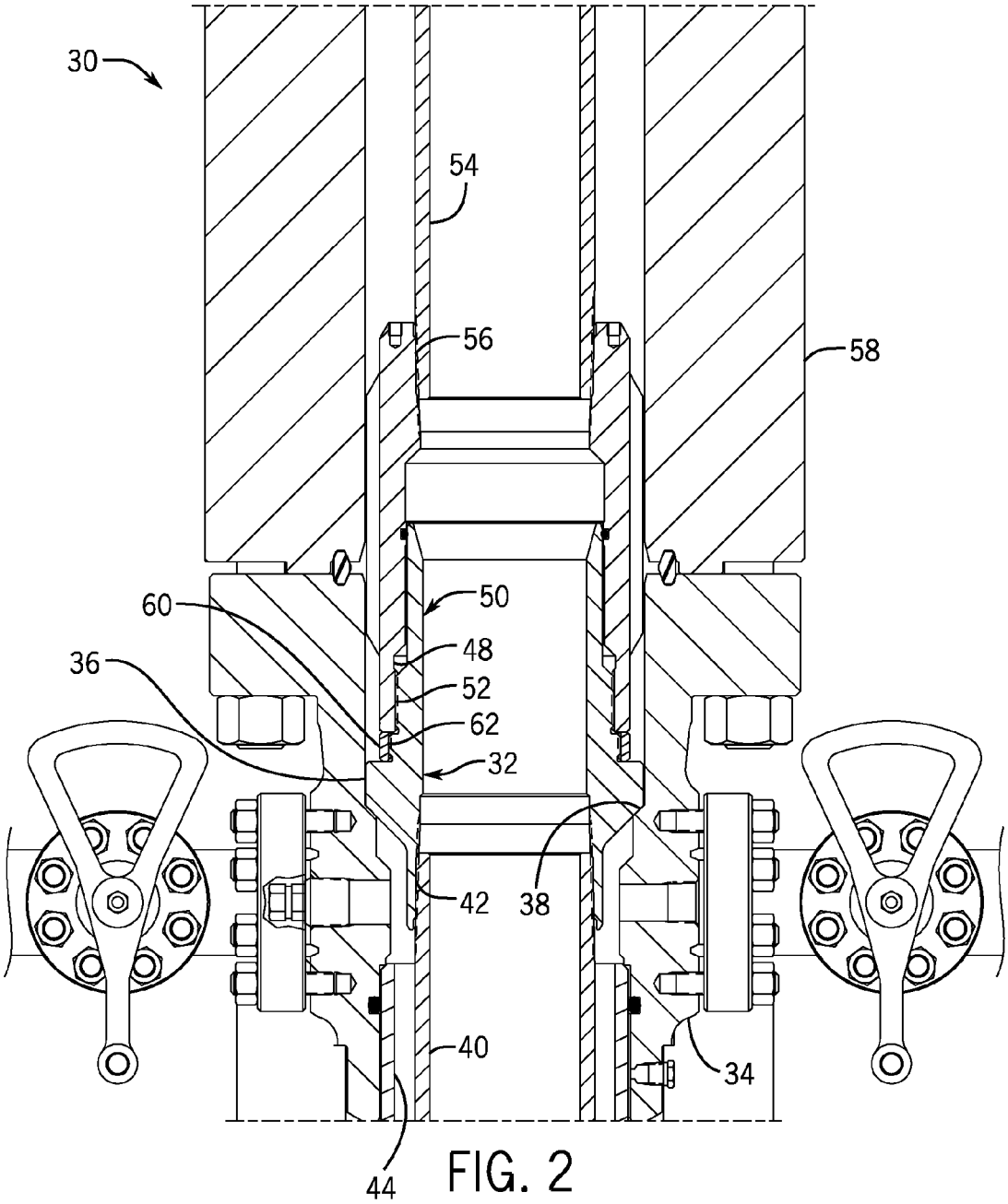
FIG. 2 is a cross-section of a wellhead assembly including a casing hanger, with a spacer and a running tool threaded onto the casing hanger, in accordance with one embodiment.

One example of a wellhead assembly 30 having a hanger installed in a hollow wellhead body is depicted in FIG. 2. As shown in this figure, the hanger is provided as a mandrel-type casing hanger 32 installed in a casing head 34. The casing hanger 32 includes a shoulder 36 that is landed onto a mating landing shoulder 38 of the casing head 34. While the shoulders 36 and 38 are depicted as integral shoulders of the casing hanger 32 and casing head 34, the shoulders could be provided separately in other embodiments. Although not shown in the present figure, it will be appreciated that the shoulder 36 can include flow-by recesses that allow fluid to flow through the shoulder 36 when the casing hanger 32 is installed in a wellhead.

A casing string 40 is attached to the casing hanger 32 by way of a threaded interface 42. This allows the casing string 40 to be lowered into a well 14 through the wellhead assembly 30 via the casing hanger 32. The casing string 40 can be run through other casing strings of greater diameter within the well, such as through a wider casing string attached to a casing hanger 44 also within the wellhead.

A running tool 48 is used to run the casing hanger 32 into the casing head 34. In FIG. 2, the casing hanger 32 has a neck 50 above the shoulder 36. The running tool 48 is threaded onto a threaded portion 52 of the neck 50, and a landing joint 54 is attached to the running tool 48 via a threaded interface 56. The landing joint 54 and the running tool 48 may be operated to lower the casing hanger 32 into the wellhead and the casing string 40 into the well. In some embodiments, the casing string 40 and the casing hanger 32 may be lowered through an additional wellhead component 58, such as through a blowout preventer stack, connected to the casing head 34. The landing joint 54 can be used to rotate the running tool 48, the casing hanger 32, and the casing string 40, such as during cementing of the casing string 40 within the well.

The wellhead assembly 30 also includes a spacer 60 attached to the casing hanger 32 between the running tool 48 and the shoulder 36. In at least some embodiments, including that depicted in FIG. 2, the spacer 60 is provided in the form of a spacer ring threaded onto a threaded portion 62 of the neck 50. This threaded portion 62 is on the neck 50 between the threaded portion 52 and the shoulder 36.

Figure 3:
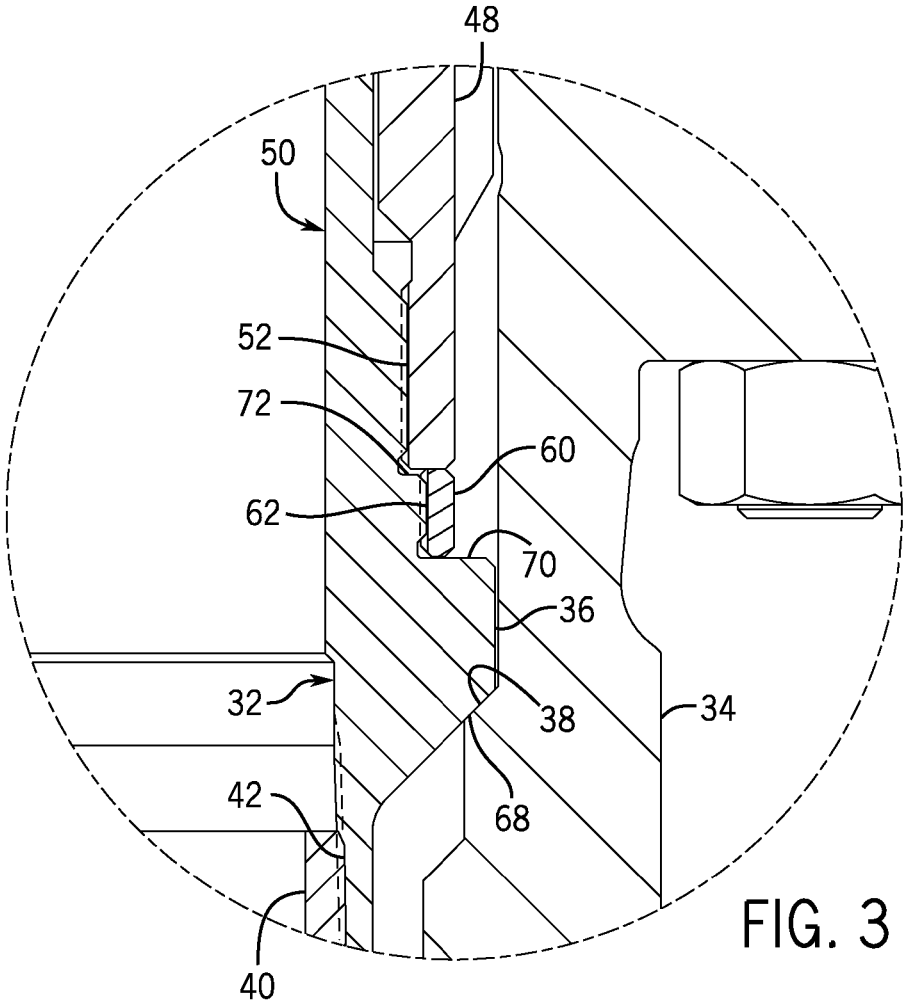
FIG. 3 is a detail view of the spacer and portions of the casing hanger and running tool of FIG. 2.

A detail view of the spacer 60 and the running tool 48 attached to the casing hanger 32 is provided in FIG. 3. As shown here, the shoulder 36 of the casing hanger 32 includes a tapered surface 68, which engages the shoulder 38 of the casing head 34, and an opposite surface 70. In at least some embodiments, the spacer 60 is threaded onto the threaded portion 62 and prevents the running tool 48 from bottoming out against surface 70 of the shoulder 36 as the running tool 48 is threaded onto the threaded portion 52 above the spacer 60. As used herein, "threaded onto" refers to relative rotation of two components to engage a threaded connection between the components and does not require a particular one of those components to be driven in rotation. For instance, the spacer 60 being threaded onto the threaded portion 62 includes rotating the spacer 60 with respect to a stationary threaded portion 62 of the neck 50, rotating the threaded portion 62 with respect to a stationary spacer 60, or rotating both the threaded portion 62 and the neck 50 with respect to one another.

The threaded portions 52 and 62 of the casing hanger 32 may have different diameters. For instance, as shown in FIG. 3, the threaded portion 62 of the neck 50 has a wider outer diameter than that of the threaded portion 52, with this difference resulting in a lateral surface 72. The spacer 60 can prevent the running tool 48 from bottoming out against this surface 72, as well.

Figure 4:
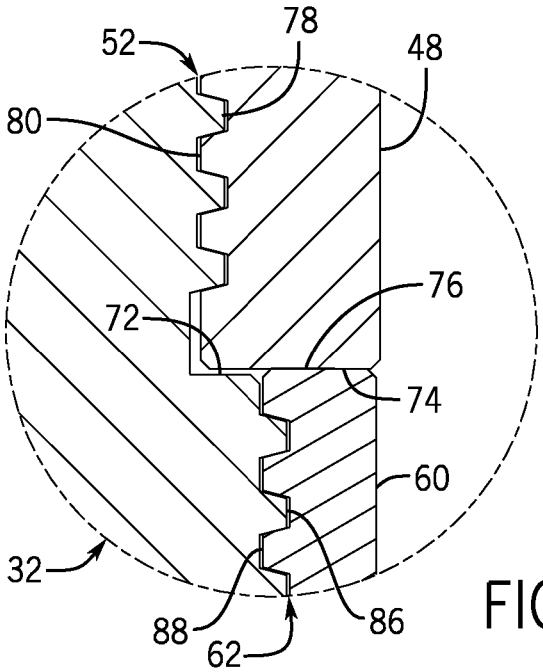
FIGS. 4 and 5 depict an example of mating threads of the spacer, the casing hanger, and the running tool of FIGS. 2 and 3 in accordance with one embodiment.
Figure 5:
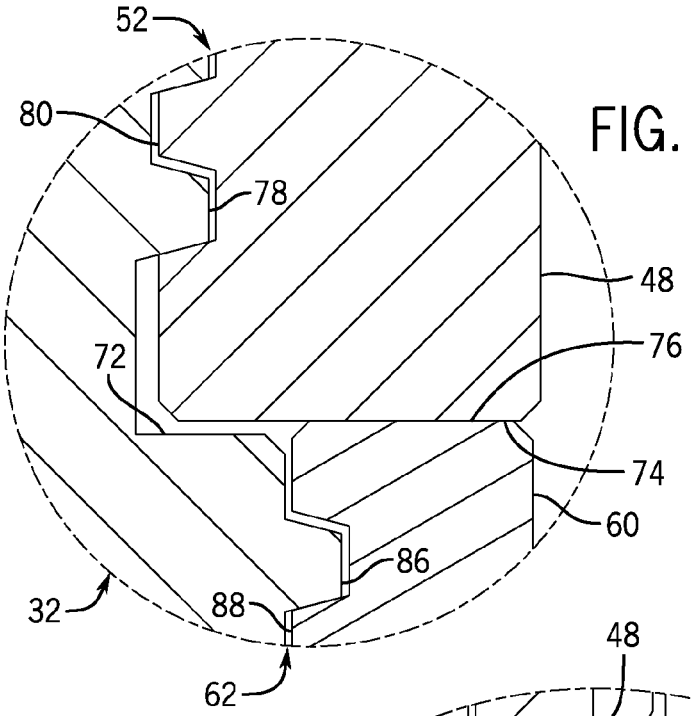

As shown in FIGS. 4 and 5, the running tool 48 and the spacer 60 can be drawn into engagement (e.g., such that end surfaces 74 and 76 of these components contact one another) along the neck 50 of the casing hanger 32. In some embodiments, the spacer 60 is threaded onto the portion 62 of the neck 50 and the running tool 48 is then threaded onto the portion 52 so that the running tool 48 translates along the neck 50 and engages the spacer 60. The spacer 60 can then be turned to increase a compressive force from the spacer 60 on the running tool 48. In other embodiments, the spacer 60 is threaded onto the portion 62, the running tool 48 is threaded onto the portion 52 but positioned apart from the spacer 60, and the spacer 60 is then turned on the portion 62 to translate the spacer 60 along the neck 50 into engagement with the running tool 48.

An example of mating threads of the casing hanger 32, the running tool 48, and the spacer 60 are also depicted in FIGS. 4 and 5. As shown in these two figures, the threaded portion 52 of the casing hanger 32 includes a thread 78 that engages a thread 80 of the running tool 48, and the threaded portion 62 of the casing hanger 32 includes a thread 86 that engages a thread 88 of the spacer 60. The threads 78, 80, 86, and 88 could be provided in any suitable manner. For instance, these threads could each be provided as a single helical thread with a trapezoidal form (e.g., an Acme thread). In other embodiments, however, these threads could be provided as multi-start threads, with different thread forms, and so forth. Mating engagement of the running tool 48 with the casing hanger 32 via threads 78 and 80 enables the casing hanger 32 to be rotated by and with the running tool 48 (e.g., when driven by a top drive via the landing joint 54). This, in turn, allows the casing string 40 to be rotated by the casing hanger 32, such as during cementing of the casing string 40 within the well.

The running tool 48 could be used without the spacer 60 to transmit torque to the casing hanger 32 and drive rotation of the casing string 40. Resistance to such rotation (e.g., from the weight of the casing string 40 or cement in the well) could cause tightening of the connection between the running tool 48 and the casing hanger 32. In some instances, such tightening would lead to over-torquing of the running tool 48 on the casing hanger 32, in which excessive friction between these two components would hinder disengagement of the running tool 48 from the casing hanger 32. That is, the tightening of the connection between these components can increase the break-out torque needed to overcome the friction in the connection and disengage the running tool 48 from the casing hanger 32, thus frustrating removal of the running tool 48 from the casing hanger 32 once it is installed within the casing head 34. If the break-out torque were excessively high, the casing hanger 32 could simply rotate with the running tool 48 when trying to unthread the running tool 48 from the neck 50, for example. But in accordance with the present techniques, the spacer 60 can be used to reduce the break-out torque needed to break the connection between the running tool 48 and the casing hanger 32.

In at least some embodiments, the surfaces of the threaded portions 52 and 62 are threaded in opposite directions to facilitate disconnection of the running tool 48 from the casing hanger 32. In certain embodiments, for example, the mating threads 78 and 80 include right-handed threads and the mating threads 86 and 88 include left-handed threads. The spacer 60 can be threaded onto the casing hanger 32 by rotating the spacer 60 in one direction (e.g., counter-clockwise in the case of mating left-handed threads 86 and 88) with respect to the casing hanger 32 to engage the mating threads 86 and 88 and to translate the spacer 60 along the neck 50 of the casing hanger 32 toward the shoulder 36. The running tool 48 can then be threaded onto the casing hanger 32 by rotating the running tool 48 in an opposite direction (e.g., clockwise in the case of mating right-handed threads 78 and 80) with respect to the casing hanger 32 to translate the rotating tool 48 along the neck 50 toward the spacer 60. The spacer 60 and the running tool 48 can be drawn into engagement with one another in any suitable manner, such as described above.

The landing joint 54 can then be rotated in the same direction as the direction in which running tool 48 was threaded onto the casing hanger 32 (e.g., clockwise) to drive rotation of the running tool 48, the casing hanger 32, and the attached casing string 40 in that direction. As noted above, such rotation can facilitate cementing of the casing string 40 within the well. As the running tool 48, the casing hanger 32, and the casing string 40 are rotated by the landing joint 54, the different orientations of the threads 78 and 80 compared to threads 86 and 88 will cause the running tool 48 to press against the spacer 60 (axially downward along the neck 50 in FIGS. 2-5) and the spacer 60 to press against the running tool 48 (axially upward along the neck in FIGS. 2-5). This mating engagement of the running tool 48 with the spacer 60 inhibits further axial travel of the running tool 48 down along the neck 50, allowing the running tool 48 to transmit torque and rotate the casing hanger 32. Additionally, the mating engagement of the running tool 48 and the spacer 60 also reduces the break-out torque necessary to begin backing the running tool 48 off of the casing hanger 32, allowing the running tool 48 to be more easily unthreaded from the threaded portion 52 and removed from the wellhead assembly 30.

Figure 6:
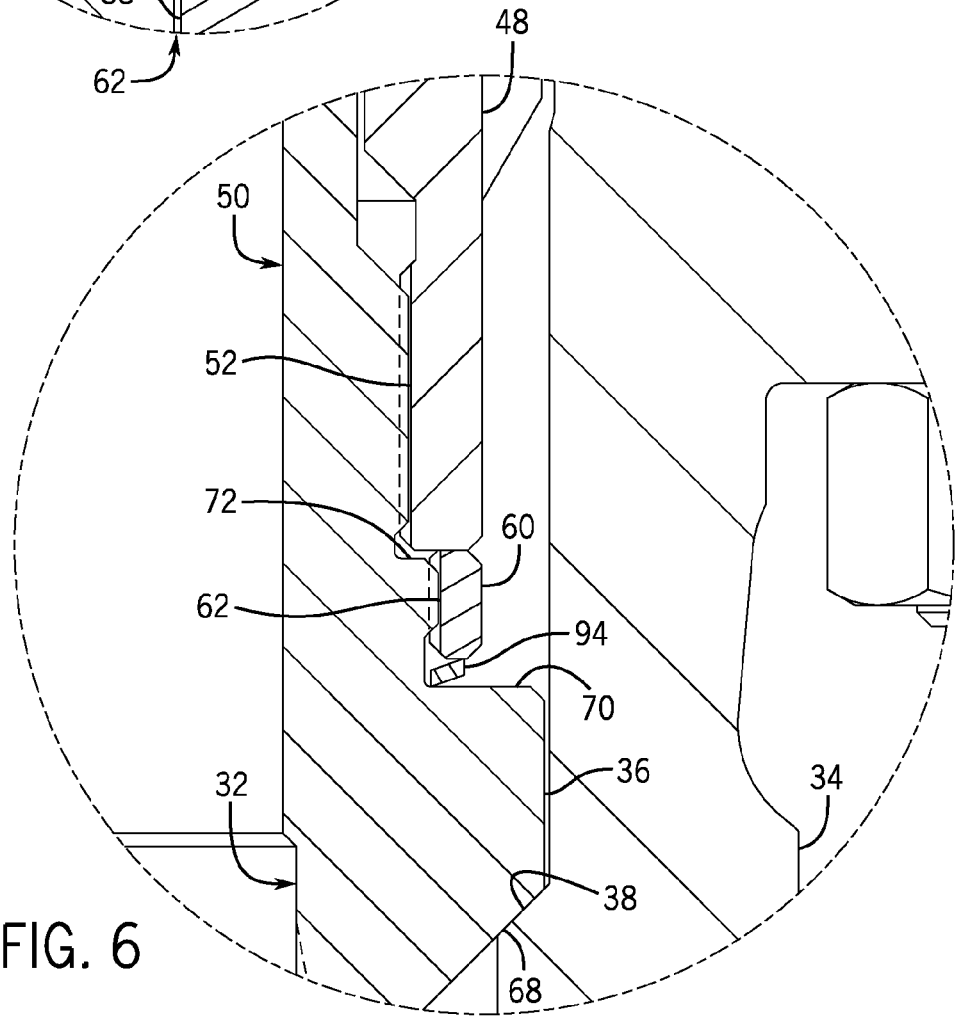
FIG. 6 depicts a spring-loaded spacer installed on a casing hanger of a wellhead assembly in accordance with one embodiment.

The spacer 60 could also be spring-biased in certain embodiments. In one embodiment generally depicted in FIG. 6, for example, a spring 94 is positioned between the spacer 60 and the shoulder 36 of the casing hanger 32. The spring 94 can include a disc spring or any other suitable spring to apply a biasing force on the spacer 60 toward the running tool 48. In the depicted embodiment, the threaded portions 52 and 62 can be threaded in opposite directions as described above. The spring 94 and the spacer 60 balance axial loading from the running tool 48 as it presses against the spacer 60 while driving rotation (e.g., in the clockwise direction) of the casing hanger 32 and the casing string 40. The spring 94 may assist the unloading of the running tool 48 against the spacer 60 when the running tool 48 is rotated in the opposite direction (e.g., counter-clockwise), thus facilitating disconnection and removal of the running tool 48 from the casing hanger 32.

Additionally, although certain embodiments are described above as having a casing hanger 32 including a spacer 60 for reducing the break-out torque needed for disconnecting a running tool 48 from the casing hanger, other embodiments may take different forms. For example, in some embodiments the hanger 32 could instead be provided as a tubing hanger for installation in a tubing head. Additionally, while the hanger 32 can be used to rotate an attached tubular string (e.g., during cementing operations), the hanger 32 might not be used for this purpose in other instances.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method comprising:

attaching a spacer to a wellhead hanger;

threading a running tool onto the wellhead hanger by rotating the running tool in a first direction with respect to the wellhead hanger to thread the running tool onto the wellhead hanger; and drawing the running tool and the spacer into engagement along the wellhead hanger;

wherein attaching the spacer to the wellhead hanger includes threading the spacer onto the wellhead hanger by rotating the spacer with respect to the wellhead hanger in a second direction, opposite the first direction, to thread the spacer onto the wellhead hanger, and wherein drawing the running tool and the spacer into engagement along the wellhead hanger includes rotating one of the running tool or the spacer in the first direction until such rotation is prevented by the other of the running tool or the spacer.

2. The method of claim 1, comprising lowering a casing string attached to the wellhead hanger into a well.

3. The method of claim 1, comprising positioning a spring between the spacer and a shoulder of the wellhead hanger.

4. The method of claim 1, comprising preventing over-torquing of the running tool on the wellhead hanger with the spacer.

5. A method comprising:

attaching a spacer to a wellhead hanger;

threading a running tool onto the wellhead hanger by rotating the running tool in a first direction with respect to the wellhead hanger to thread the running tool onto the wellhead hanger;

drawing the running tool and the spacer into engagement along the wellhead hanger, wherein drawing the running tool and the spacer into engagement along the wellhead hanger includes rotating one of the running tool or the spacer in the first direction until such rotation is prevented by the other of the running tool or the spacer;

lowering a casing string attached to the wellhead hanger into a well; and rotating the casing string in the first direction via the wellhead hanger and the running tool, wherein the engagement of the running tool with the spacer causes rotation of the running tool to be applied to the wellhead hanger and the spacer reduces torque needed to unthread the running tool from the wellhead hanger.

6. A method comprising:

attaching a spacer to a wellhead hanger;

threading a running tool onto the wellhead hanger by rotating the running tool in a first direction with respect to the wellhead hanger to thread the running tool onto the wellhead hanger;

drawing the running tool and the spacer into engagement along the wellhead hanger; and preventing over-torquing of the running tool on the wellhead hanger with the spacer;

wherein attaching the spacer to the wellhead hanger includes threading the spacer onto the wellhead hanger by rotating the spacer with respect to the wellhead hanger in a second direction, opposite the first direction, to thread the spacer onto the wellhead hanger, and wherein preventing over-torquing of the running tool on the wellhead hanger with the spacer includes using the spacer to prevent rotation of the running tool in the first direction once the running tool and the spacer are drawn into engagement along the wellhead hanger.

* * * * *